United States Patent [19]

Olsson

[11] 4,088,048

[45] May 9, 1978

[54] METHOD AND DEVICE FOR HOLING

[75] Inventor: Hans Olsson, Östersund, Sweden

[73] Assignee: Hans Olssons Mekaniska Verkstad AB, Ostersund, Sweden

[21] Appl. No.: 737,181

[22] Filed: Nov. 1, 1976

[30] Foreign Application Priority Data

Nov. 3, 1975 Sweden ..... 7512281

[51] Int. Cl.[2] ..... B26F 1/34

[52] U.S. Cl. ..... 83/55; 83/554; 30/358; 30/361; 60/567

[58] Field of Search ..... 30/361, 358, 180; 60/567; 83/50, 55, 554, 925 R

[56] References Cited

U.S. PATENT DOCUMENTS

| | | | |
|---|---|---|---|
| 198,176 | 12/1877 | Alexander | 60/567 |
| 388,977 | 9/1888 | Hulme | 30/361 |
| 641,175 | 1/1900 | Wigtel | 30/361 |
| 840,859 | 1/1907 | Morse | 83/554 |
| 2,032,185 | 2/1936 | Sciaky | 60/567 X |
| 2,443,642 | 6/1948 | Rockwell | 60/567 X |

FOREIGN PATENT DOCUMENTS

| | | | |
|---|---|---|---|
| 567,153 | 12/1923 | France | 60/567 |

*Primary Examiner*—J. M. Meister
*Attorney, Agent, or Firm*—Haseltine, Lake & Waters

[57] ABSTRACT

A method and a device for holing an oblong member, particularly a guard rail, substantially directly in front of a hole in a second member, particularly a pole, by utilizing a punching device comprising a punch and first and second pressure means with different ratios, of which the first means causes the punch to abut the oblong member, and the second means effects further movement of the punch to carry out holing in said member.

5 Claims, 2 Drawing Figures

METHOD AND DEVICE FOR HOLING

BACKGROUND OF THE INVENTION

Figure 1:
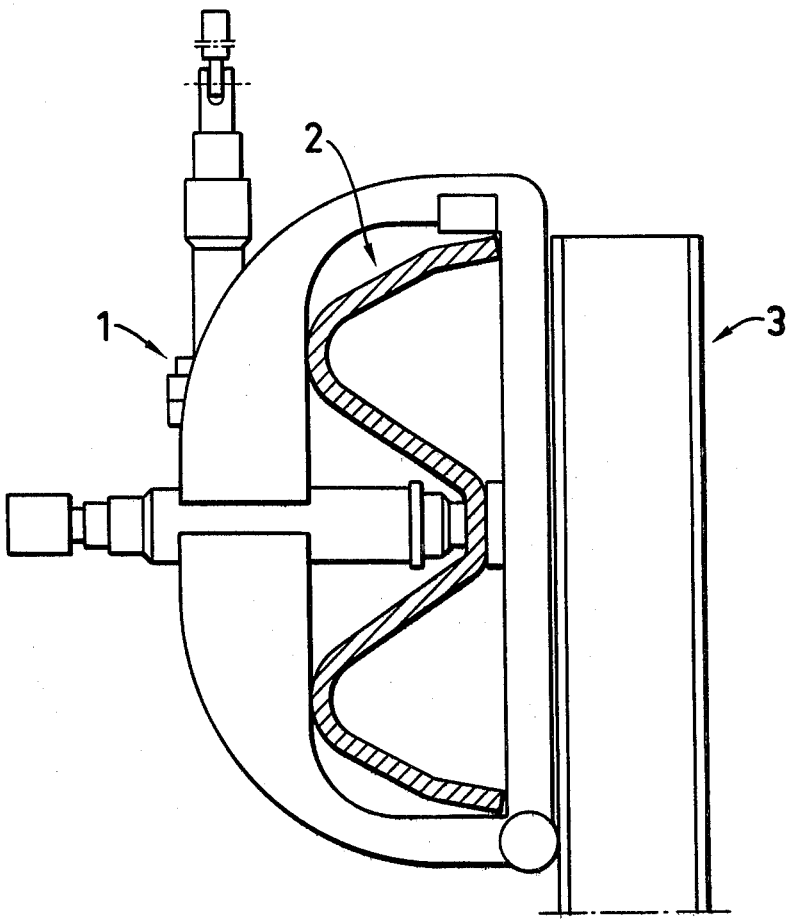

This invention relates to a method and a device for holing an oblong member, particularly a guard rail, substantially directly in front of a hole in a second member, particularly a pole.

At present the methods of mounting road guard rails in principle comprise the steps of positioning a prefabricated hole in the guard rail directly in front of a prefabricated hole in a pole and thereafter to connect the pole and the rail by means of a bolt or the like. This method, however, requires that the pole division, i.e. their relative spacing, shows very small tolerances, because otherwise the two holes would not lie directly in front of each other. To mount poles with such a high accuracy concerning their spacing, however, is very tedious and thus also expensive.

SUMMARY OF THE INVENTION

This invention has the object to eliminate the deficiencies and disadvantages of the method described above by disclosing a method and a device for punching holes in situ in road guard rails, i.e. the hole in the road guard rail is positioned directly in front of the hole in the pole. This is effected thereby that a punching device comprising a punch and a first and a second pressure means with different ratios for actuating the punch is moved along the rail until the punch is positioned substantially directly in front of the hole in the pole, whereafter the punch by action of the first pressure means is caused to contact the rail, and that thereafter holing is carried out by a further movement of the punch actuated by the second pressure means.

Other objects and advantages of the present invention will be understood with reference to the accompanying specification, claims and drawings.

IN THE DRAWINGS

Figure 2:
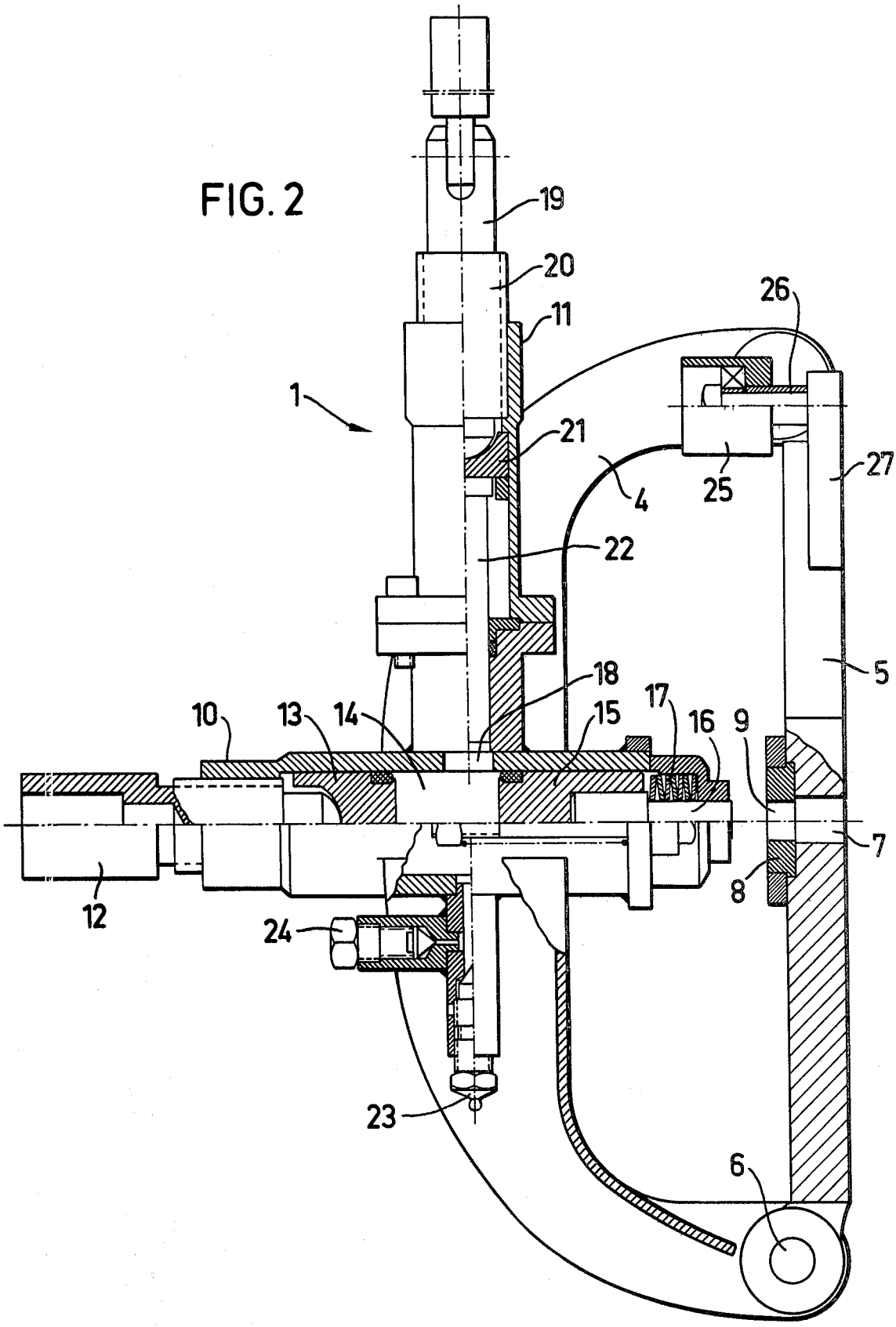

FIG. 1 schematically shows the punching device attached to a road guard rail directly in front of a pole, and FIG. 2 shows in greater detail a punching device partially in section.

EXPLANATION OF INVENTION

FIG. 1 schematically illustrates how the punching device according to the invention is attached to a road guard rail 2 for holing the rail. FIG. 1 further shows a pole 3, on which the rail 2 is mounted after the holing. The holing briefly is carried out in such a manner, that the device 1 is moved along the rail 2 until the device 1 is located directly in front of a pole 3. Thereafter a hole is punched in the rail 2 directly in front of the corresponding hole in the pole 3. The device 1 is thereafter moved to the next pole for punching a hole therein, etc. The rail and the pole can be connected in conventional manner by a bolt or the like.

In FIG. 2 the punching device 1 is shown in greater detail. Its construction and function are described as follows:

The device comprises a yoke 4, which at its upper end is hingedly connected to the upper end of a plate 5. The lower end of the plate 5 can be coupled together with the lower end of the yoke 4 by a split pin 6. The plate 5 is in its centre provided with a hole 7. Directly in front of this hole, on the side of the plate 5 facing toward the yoke 4, a die 8 is attached which is provided with a hole 9.

The yoke 4 carries two hydraulic pressure cylinders 10 and 11 arranged perpendicularly relative one another. The first pressure cylinder 10 comprises a threaded screw 12, which engages with a sleeve provided in the cylinder 10 and threaded on its inside. The screw 12, thus, by turning can be displaced relative to the first cylinder 10. The screw 12 abuts with its end facing toward the plate 5 a piston 13. The cylinder 10 contains a hydraulic medium 14, for example fat, a further piston 15 and thereafter a punch 16 countersunk in the piston and surrounded by a cup spring 17.

The second cylinder 11 in perpendicular relationship to the first cylinder 10 communicates with the latter through a hole 18, which opens into the cylinder 10 in the area of the hydraulic medium 14. The second cylinder 11 comprises outermost a threaded screw 19, which cooperates with the threaded inner surface of a sleeve 20. The inner end of the screw 19 abuts a piston 21, which in its turn is in contact with a pressure rod 22, the inner end of which thus is in contact with the hydraulic medium 14 via the hole 18. The diameter of the pressure rod 22 is substantially smaller than the diameter of the piston 13.

The punching device 1 further comprises a charging valve 23 for charging hydraulic medium 14. In connection to the charging valve 23 a safety valve 24 is provided to prevent the pressure in the cylinders 10 and 11 from exceeding a predetermined value.

Roller bodies 25 are attached to sleeves 26, which are mounted on lugs 27 projecting from the plate 5. The roller bodies 25 are intended to abut the road guard rail 2.

Also within the scope of the invention is a method at holding a road guard rail. Accordingly, the punching device 1 is suspended on a road guard rail 2 (see FIG. 1) so that the roller bodies 25 abut the upper edge of the rail 2. The punching device 1 is locked on the rail 2 by means of a split pin 6 connecting the plate 5 with the yoke 4 at the lower end thereof. The punching device 1, thus, can be moved along the rail 2 by means of the roller bodies 25. The punching device is set directly in front of a pole 3 (see FIG. 1), and the hole 7 in the plate 5 is positioned directly in front of the corresponding hole in the pole 3. By turning the screw 12 the piston 13 is caused to move inward and thereby actuates the hydraulic medium 14, which in its turn moves the piston 15 and the punch 16 countersunk therein, which thereby is caused to abut the road guard rail 2. Due to the relatively large diameter of the piston 13, this movement of the punch 16 occurs relatively rapidly. The holing proper, however, is very difficult to carry out with the screw 12, and therefore the second cylinder 11 is used instead. As already mentioned, the pressure rod 22 of the second cylinder 11 has a substantially smaller diameter than the piston 13, so that their ratio is widely different. The force required for turning the screw 19 of the second cylinder 11, thus, is substantially smaller than the force which would have been required for the screw 12. By turning the screw 19, thus, the piston 21 and pressure rod 22 are moved downward and actuate the hydraulic medium 14, which additionally displaces the piston 15 and punch 16 until holing has been effected in the road guard rail 2. Thereafter, the screw 12 is turned outward, and the punch 16, piston 15, hydraulic medium 14 and piston 13 are moved to the left in FIG. 2 by action of the spring 17.

The punching device is rolled further to the next pole for a new holing operation, etc.

A number of modifications, of course, can be made at the punching device according to the invention without leaving the scope of its idea. The pressure cylinders, for example, other non-hydraulic pressure means may be employed, which are operated, for example, by electric motors or in some other way.

Many modifications and variations of the present invention are possible in light of the above teachings. It is, therefore, to be understood that within the scope of the appended claims, the invention may be practiced otherwise than as particularly described.

What I claim is:

1. A method of holing an oblong member, such as a guard rail or the like, substantially directly in front of a hole in a second member, such as a pole or the like, including the steps of: positioning a punching device having a punch, and a first and a second pressure means for actuting the punch, on said oblong member; moving said punching device along the oblong member by roller means until the punch is located substantially directly in front of the hole in the second member; actuating said punch by said first pressure means to thereby cause said punch to abut the oblong member; and holding said oblong member by moving the punch by actuating the second pressure means.

2. A method according to claim 1, including the steps of: actuating the punch by the first pressure means via a hydraulic medium at a lower ratio than the second pressure means.

3. A punching device for holing an oblong member, such as a guard rail, substantially directly in front of a hole in a second element, such as a pole, said device including: a yoke; a plate hingedly connected to one end of the yoke and detachably connected to the other end of the yoke, said yoke and said plate being adapted to enclose the oblong member; a punch; and second pressure means for actuating said punch, said pressure means each having different ratios, whereby at equal torque, the punch being actuated with different pressure forces relative to each other; and roller means associated with said device, bearing against said oblong member for movement therealong.

4. A device according to claim 3 wherein the pressure means comprise a hydraulic medium.

5. A device according to claim 3 wherein: the first pressure means comprises a screw disposed to actuate a first piston for governing a hydraulic medium driving a second piston mounting the punch.

* * * * *